US006588300B2

(12) United States Patent
Ford et al.

(10) Patent No.: US 6,588,300 B2
(45) Date of Patent: Jul. 8, 2003

(54) APPARATUS AND METHOD FOR REMOTELY VENTING PRESSURIZED CONTAINERS

(76) Inventors: Daniel D. Ford, 11515 - 440$^{th}$ St. Ct. E., Eatonville, WA (US) 98328; John S. Gala, 1835 N. Lenore Dr., Tacoma, WA (US) 98406

( * ) Notice: Subject to any disclaimer, the term of this patent is extended or adjusted under 35 U.S.C. 154(b) by 0 days.

(21) Appl. No.: 09/765,241

(22) Filed: Jan. 17, 2001

(65) Prior Publication Data

US 2001/0020692 A1 Sep. 13, 2001

Related U.S. Application Data

(60) Provisional application No. 60/178,537, filed on Jan. 26, 2000.

(51) Int. Cl.$^{7}$ ..... B67B 7/42

(52) U.S. Cl. ..... 81/3.15; 81/3.36; 81/451; 81/124.2; 81/177.2; 81/176.15

(58) Field of Search ..... 81/3.15, 3.07, 81/3.36, 3.29, 52, 54, 58.1, 58, 451, 124.2, 124.7, 177.2, 176.1–176.2, 180.1; 137/15, 315, 319–323; 251/230, 291–293; 220/203.07

(56) References Cited

U.S. PATENT DOCUMENTS

| | | | | | |
|---|---|---|---|---|---|
| 654,858 | A | | 7/1900 | Strassheim | |
| 991,047 | A | | 5/1911 | Cole | |
| 1,527,103 | A | | 2/1925 | Yaussi | |
| 1,546,629 | A | | 7/1925 | Dawe | |
| 2,447,770 | A | | 8/1948 | Ratchford | 81/3.36 |
| 2,643,566 | A | | 6/1953 | Santos et al. | 81/71 |
| 3,274,864 | A | | 9/1966 | Chapman | 81/90 |
| 3,815,451 | A | * | 6/1974 | Penner | 279/79 |
| 5,003,844 | A | | 4/1991 | Barrow | 81/3.2 |
| 5,134,905 | A | | 8/1992 | Brennan et al. | 81/3.07 |
| 5,349,755 | A | | 9/1994 | Haywood | 30/443 |
| 5,425,289 | A | * | 6/1995 | Iwinski | 81/124.5 |
| 5,634,484 | A | | 6/1997 | Vodila et al. | 137/15 |

* cited by examiner

*Primary Examiner*—D. S. Meislin
(74) *Attorney, Agent, or Firm*—Christensen O'Connor Johnson Kindness PLLC

(57) ABSTRACT

An apparatus and method for remotely venting or opening a container sealed by a bung. The apparatus comprises a support structure, a means for attachment to the container by a strap, a bung wrench, and means for aligning and rotatably supporting the bung wrench. The alignment means allows the bung wrench to accommodate any deformation of the container face. The bung wrench can include a ratchet for multiple turns of the bung. An extension arm is connected to the bung wrench, and a cable is attachable to the end of the extension arm. The cable is attached to the extension arm, and extended away from the container in a direction whereby pulling the cable sufficient to move the extension arm will produce the desired rotation of the bung, thereby venting the container.

16 Claims, 4 Drawing Sheets

APPARATUS AND METHOD FOR REMOTELY VENTING PRESSURIZED CONTAINERS

CROSS-REFERENCE TO RELATED APPLICATION

This application claims the priority of Provisional Application No. 60/178,537 filed Jan. 26, 2000.

BACKGROUND OF THE INVENTION

1. Field of Invention

The present invention discloses a method and apparatus for venting containers sealed by a bung, such as containers of the type commonly used to store and transport hazardous materials. The invention in particular pertains to a method and portable apparatus for remotely loosening the bung on a potentially over-pressurized container, thereby safely relieving excess pressure in the container thereby potentially avoiding a container rupture.

2. Description of Related Art

Containers, usually made from steel or plastic and having capacities ranging from 30 to 85 gallons, have long been used to transport and/or store a variety of commercial primary and waste products. These containers provide a tightly sealed container and are therefore well suited for storing and for transporting hazardous wastes and other reactive liquid chemical products.

Containers containing hazardous materials must be kept tightly sealed for transportation and storage in order to reduce the risk of accidental spillage and contamination of facilities and the consequent risk to hazardous materials handling personnel. When these sealed containers are heated, either through exposure to catastrophic accident conditions such as fires, or simply through normal weather-related environmental heating, the pressure in the containers can rise. Over-pressurization can also result from unanticipated chemical reactions occurring inside the container. Over-pressurization of containers can cause catastrophic failure in the container. Numerous incidents of fire, explosion, and ground contamination have occurred at various facilities over the last several years due to container rupture caused by over-pressurization events.

When a container becomes over-pressurized, the walls of the container, including the top and bottom panels, will often be deformed by the internal pressure buildup. It is desirable, in over-pressurization events, to loosen the container bung or to puncture the upper container panel in order to release the pressure prior to a catastrophic failure of the container walls. When the over-pressurization is caused or exacerbated by ongoing chemical reactions in the container it is particularly important to release the pressure as soon as possible. When the container contains hazardous materials, however, releasing the pressure becomes problematic and potentially hazardous. The rapid release of pressure and expulsion of gasses from the container during depressurization may cause a quantity of the container contents to spray out of the container, posing a hazard to any person in the immediate vicinity. Also, the pressure build up and container panel deformation may be sufficient to cause the bung cap to be ejected from the container with sufficient momentum to present a hazard to any worker in the area. Moving the container to a different location without depressurization, on the other hand, increases the risk that the pressure and/or stresses associated with transportation will generate sufficient force to rupture the container and increases the time before the pressure is released, further increasing the risk of catastrophic failure of the container.

Similar hazards are present when Hazardous Materials Response Teams (HazMat Teams) are called upon to deal with hazardous waste and materials storage facilities or abandoned or discarded container sites. Some of theses containers may be very dangerous to deal with due to container deterioration resulting from age and exposure to the elements, pressure build-up inside the container, and potentially unknown hazardous materials contained in the containers.

Current technologies in the field offer few solutions to these problems. The most commonly used method of handling containers of this nature is to simply vent the container manually, either by loosening the container bung with a bung wrench such as those described in U.S. Pat. No. 654,858 or U.S. Pat. No. 2,643,566, or by puncturing the container with some type of hand-held apparatus. While these methods offer the advantages of rapid container venting and requiring only a single worker to be exposed to danger, the individual worker executing this method may be subjected to released chemicals upon venting the containers, or may be injured, dismembered, or killed due to bung cap ejection or potentially by an explosion of unstable chemicals inside the container.

Another approach to this problem is typified by the Portable Remote Drum Opening Device disclosed by Haywood in U.S. Pat. No. 5,349,755 wherein a power-driven venting system, powered either by air or electricity, is installed onto an over-pressurized container which either drives a punch to pierce the head of the container, or turns a bung socket to loosen the container bung. These types of system, however, typically are expensive to own, require two or more persons to operate, and require a nearby power source for operation. Due to the high cost of such systems, they will frequently not be available at remote locations. Moreover, the use of electricity may present a risk of sparks igniting potentially flammable gases vented from the container.

A portable, hand-held device for remotely venting a container has been disclosed by Vodila et al. in U.S. Pat. No. 5,634,484. The disclosed device is apparently attached to a container, with a downwardly-projecting shaft terminating with a bung wrench. A second shaft engages the first shaft with a set of matching gears, such that rotation of the second shaft causes rotation of the first shaft and bung wrench. While this tool provides a helpful, albeit short, distance between the operator and the container bung, the operator still must remain in fairly close proximity to the bung. Also, no leverage is provided to facilitate bung removal. Moreover, the disclosed invention would not accommodate a bung that has been displaced a significant amount from the horizontal design condition, as is frequently the case in over-pressurization events wherein internal pressure deforms the container head.

Whatever method is used to vent the container. It is common for container over-pressurization events to result in the mobilization of several levels of emergency response teams at considerable cost and disruption.

There is a need for a simple, portable non-powered tool that will permit containers containing hazardous materials to be vented remotely and in situ prior to pressure in the container building up to levels sufficient to rupture the container. The disclosed invention is an article of manufacture designed to allow a single operator to vent an over-pressurized container from a safe distance, thus reducing the risk of injury to personnel on account of bung cap ejection, explosion, or inadvertent contact with harmful chemicals.

SUMMARY OF THE INVENTION

It is an object of the present invention to provide a portable apparatus for remotely venting a container having a bung, comprising a means for attaching the apparatus to the container, a support structure connected to the attachment means that extends over the top of the container, a bung wrench rotatably connected to the support structure in a position to engage the bung, an extension arm rigidly attached to the bung wrench, and an elongated member attached to the extension arm, whereby a user can rotate the bung from a safe distance by pulling on the elongated member.

It is a further object of the present invention to provide such apparatus wherein the bung wrench is made from a non-sparking metal such as aluminum or bronze.

It is a further object of the present invention to provide such apparatus wherein the angular position of the bung wrench with respect to the bung on the container may be adjusted.

It is a further object of the present invention to provide such apparatus that may be attached and operated by a single individual.

It is a further object of the present invention to provide a means to make multiple turns of the bung from a safe distance by incorporation of a rachet into the apparatus.

These and such other objects of the invention as will become evident from the disclosure below are met by the invention disclosed herein. In addition to the explicitly claimed method and apparatus described herein, as such, it is to be understood that all new and useful devices or components described herein are considered to constitute a part of the invention, claimable in their own right, whether such is stated with particularity herein or not.

DETAILED DESCRIPTION OF THE INVENTION AND BEST MODE

Figure 1:
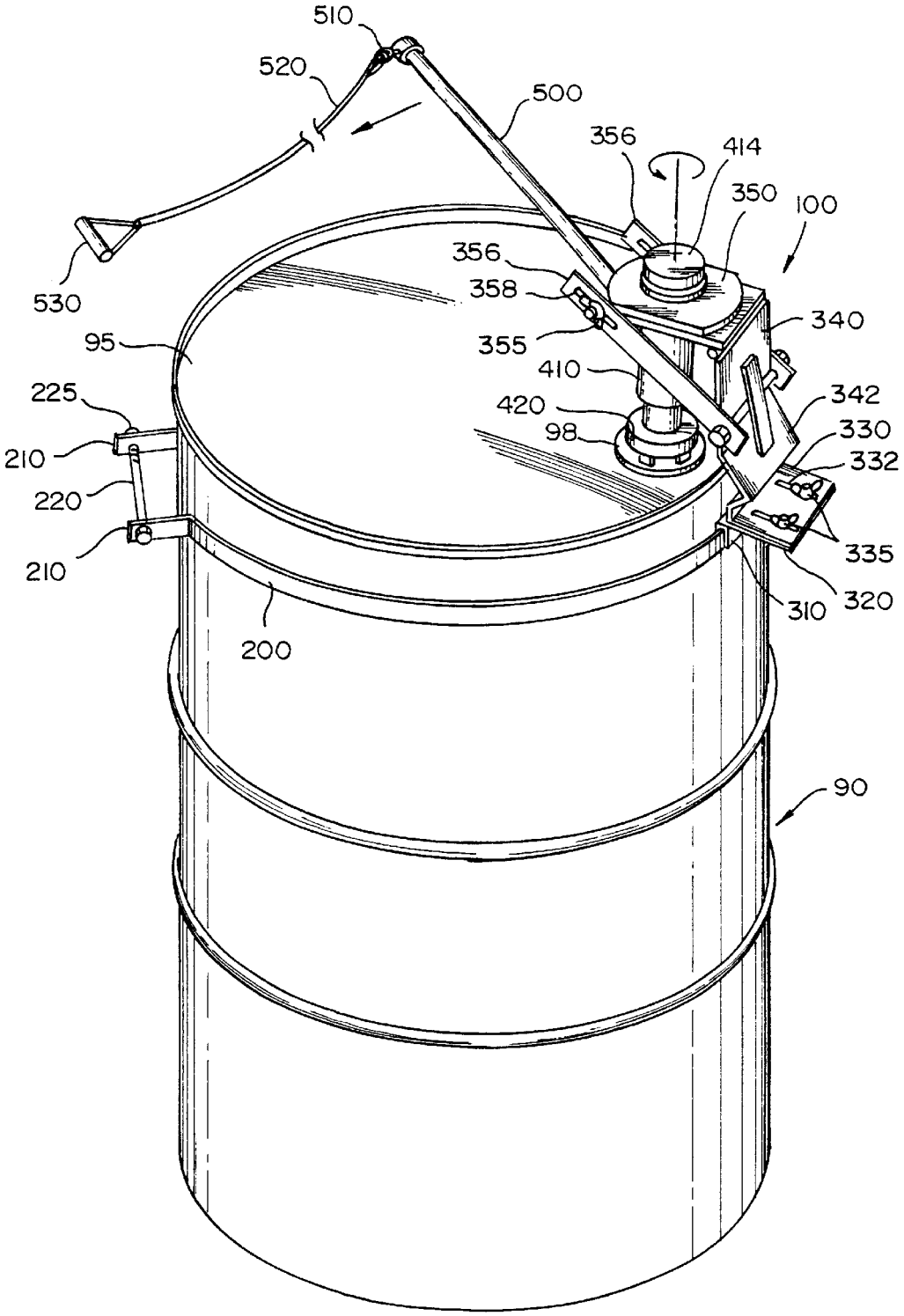
FIG. 1 is a perspective view showing the preferred embodiment of the present invention attached to a container.

Turning now to the drawings, the invention will be described in a preferred embodiment by reference to the numerals of the drawing figures wherein like numbers indicate like parts.

Figure 5:
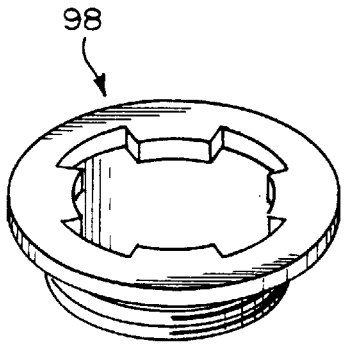
FIG. 5 is a detail perspective view of a typical bung (not a part of the present invention).

Steel or plastic container containers, conventionally in 30, 55 and 85 gallon sizes, are used ubiquitously to store and/or transport hazardous liquid products. Because the containers are sealed to prevent leakage of their contents, they are subject to unanticipated over-pressurization events wherein external heat or chemical reactions in the container cause the pressure to increase above ambient pressure. The present invention provides a method and apparatus for venting a container container, such as the conventional container 90 shown in FIG. 1, by loosening the threaded bung 98 that is generally provided on the top surface 95 of the container 90. A typical bung 98 is shown in FIG. 5. The present invention allows the bung 98 to be rotated from a safe distance, thereby venting any over-pressurization that may have occurred in the container 90.

As shown most clearly in FIG. 1 and described in more detail below, the remote bung wrench 100 is comprised of a strap 200 that attaches the apparatus to the container 90, a bung wrench support structure 300 connected to the strap 200 that allows the bung wrench 400 to be adjustably positioned to engage the bung 98, and an extension arm 500 with an attachable cable 510 that allows the user to rotate the bung wrench 400, and therefore the bung 98, by pulling on the cable 510 from a safe distance.

An adjustable strap 200, such as a long narrow object or piece of material sufficiently flexible material, having a generally circular shape, and sized to fit around the desired container 90, attaches the remote bung wrench 100 to the container 90. In the preferred embodiment the circular strap 200 has a split portion with two tabs 210 projecting therefrom, approximately parallel to each other. The two tabs 210 are connected with a bolt 220 having a wingnut 225 that can be tightened to pull the two tabs 210 toward each other, thereby tightening the strap 200 on the container 90. The strap 200 is preferably made from a metal strip approximately 1 inch wide. As will be obvious to one of ordinary skill in the art, the length of the strap 200 and the threaded portion of the bolt 220 may be selected to allow the strap 200 to accommodate all conventionally-sized containers.

A bung wrench support structure 300 is attached to the strap 200. The support structure 300 comprises a connecting portion 310 that connects to the strap 200, a lower horizontal plate 320 that projects outwardly from the connecting portion 310 away from the strap 200, an upper horizontal plate 330 slidably attachable to the lower horizontal plate 320, a vertical plate 340 attached to, and projecting upwardly from the upper horizontal plate 330, and a wrench support plate 350 hingedly connected to the vertical plate 340. As can be most clearly seen in FIG. 2, the connecting portion 310 consists of two parallel sections that form a channel approximately as wide as the thickness of the strap 200, allowing the strap 200 to be slidably inserted into the connecting portion 310. The strap 200 and connecting portion 310 may then be crimped, welded or otherwise joined together to form a secure connection. To facilitate assembly of the connecting portion 310 and the strap 200, the connecting portion 310 also has a radius of curvature along its length that approximately matches the radius of curvature of the strap 200.

The lower horizontal plate 320 is attached to the connecting portion 310, and extends generally horizontally outwardly from the connecting portion 310. The lower horizontal plate 320 includes two upwardly-facing threaded bolts 325. The upper horizontal plate 330 sits atop the lower horizontal plate 320, and has a pair of slots 332 that accommodate the bolts 325 whereby the upper horizontal plate 330 is constrained to slide toward or away from the strap 200. A pair of wing nuts 335 screw onto the threaded bolts 325 to rigidly tighten the upper horizontal plate 330 to the lower horizontal plate 320.

The vertical plate 340 is rigidly connected to the upper horizontal plate 330, and extends generally perpendicularly therefrom. In the preferred embodiment, the vertical plate 340 includes an offset portion 342 that extends away from the strap 200, as shown most clearly in FIG. 2. This offset portion 342 is necessary to accommodate certain conventional containers (not shown) that have a narrow horizontal lip on the upper edge that projects outwardly.

Figure 2:
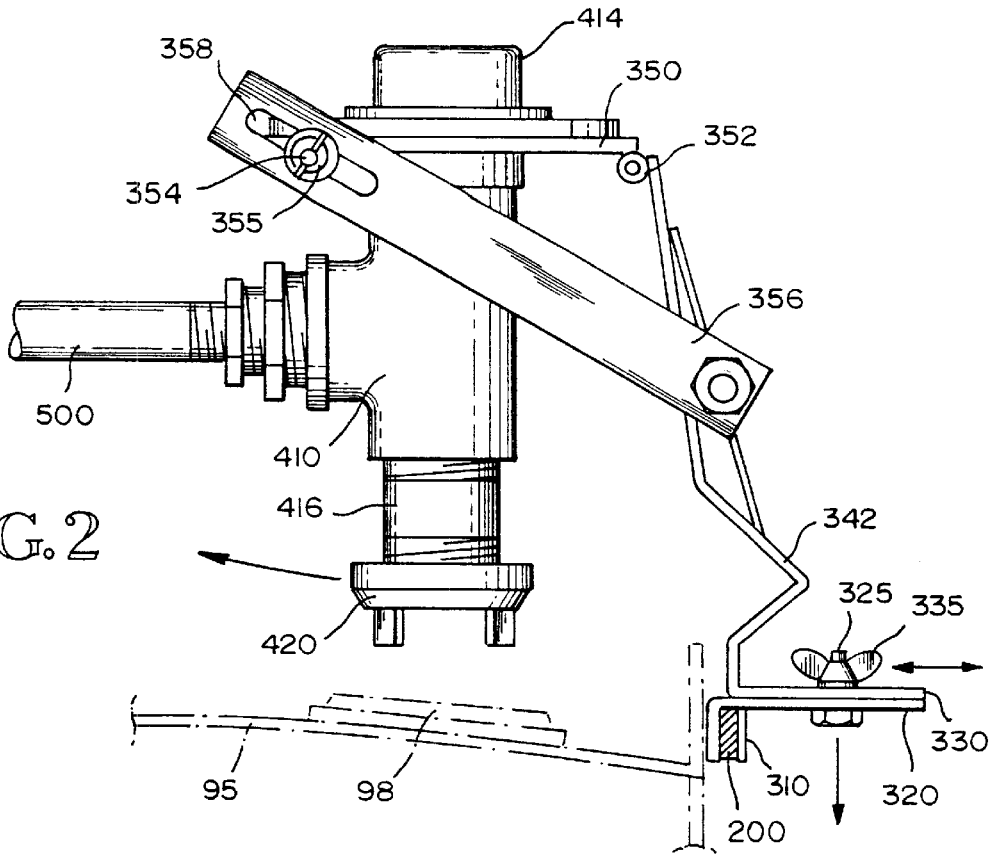
FIG. 2 is a side view of the preferred embodiment shown in FIG. 1.
Figure 3:
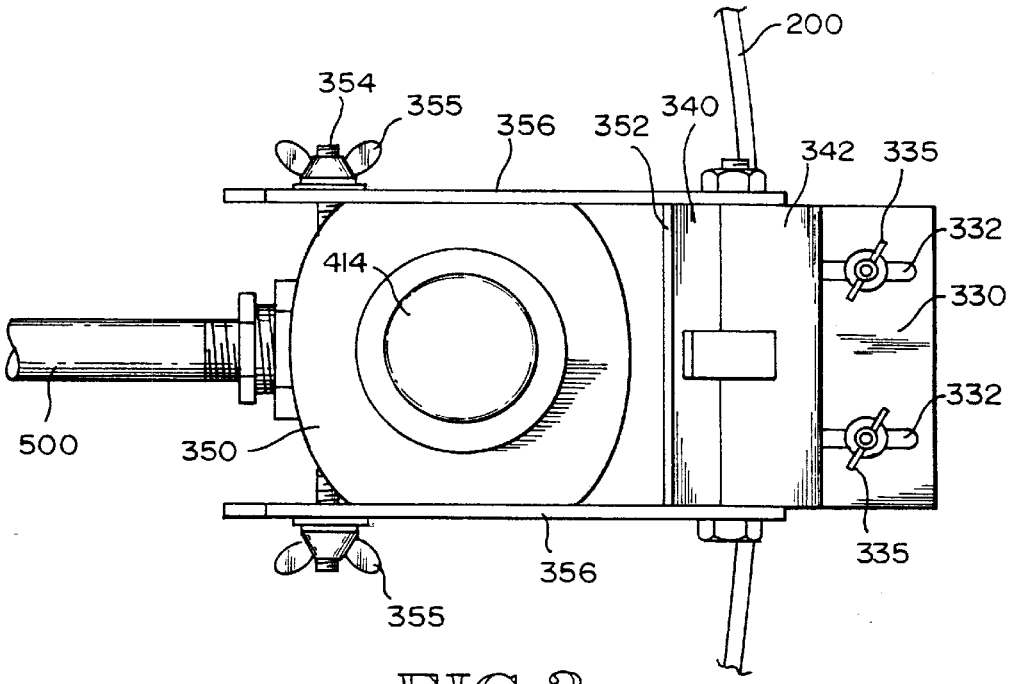
FIG. 3 is a top view of the preferred embodiment shown in FIG. 1.

The wrench support plate 350 is connected to the vertical plate 340 with a hinge 352. The wrench support plate 350 extends generally perpendicularly from the vertical plate 340, although the hinge 352 allows the angle between the wrench support plate 350 and the vertical plate 340 to be adjusted. A threaded shaft 354 is attached near the edge of the wrench support plate 350 opposite the hinge, with threaded portions projecting from either side of the hinge support plate 350. As shown in FIGS. 1 and 2, a pair of elongate slotted struts 356 are hingedly connected to the vertical plate 340 and extend diagonally therefrom. The slots 358 engage the threaded shaft 354 on either side of the wrench support plate 350. Wing nuts 355 screw on to either end of the threaded shaft 354.

Figure 4:
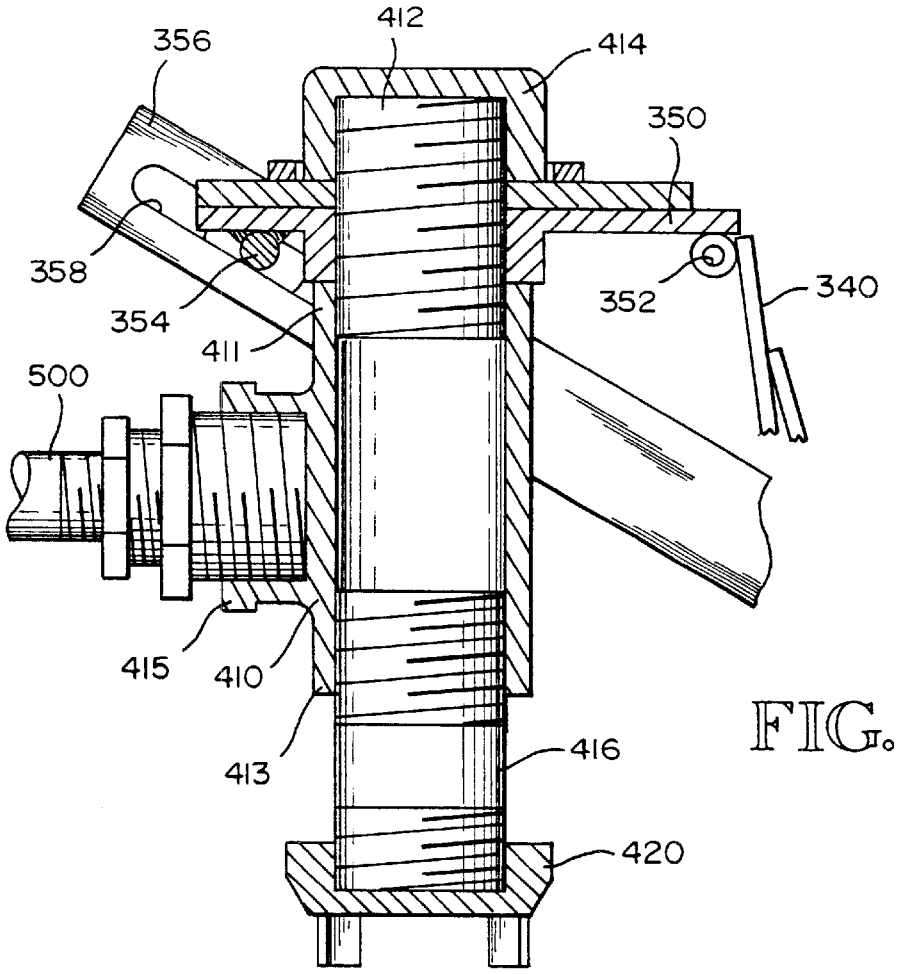
FIG. 4 is a detail sectional view of the bung wrench.

A bung wrench 400 is rotatably attached to the wrench support plate 350, extending generally downwardly therefrom. In the preferred embodiment shown most clearly in FIG. 4, the bung wrench 400 comprises a rigid tubular T-connector 410 having all three legs internally threaded. A tubular connector 412 engages the top leg 411 of the T-connector 410, and is inserted through the wrench support plate 350. An end cap 414 rotatably secures the T-connector 410 to the wrench support plate 350. A second tubular connector 416 engages the bottom leg 413 of the T-connector 410. A removable bung engagement 420 for engaging the container bung 98, is attachable to the bottom of the second tubular connector 416. In the preferred embodiment the bung engagement 420 is removable so that different bung engagement may be selected to accommodate different bung configurations. The bung engagement 420 are preferable made from bronze, aluminum or some other non-sparking metal, to reduce the possibility of creating a spark in a potentially flammable environment.

As described above, and shown in the drawings, the present invention allows the user to adjust the vertical position of the bung wrench 400 by adjusting the vertical location of the strap 200 on the container 90. The horizontal position of the bung wrench 400 may also be adjusted by the slidably connected lower horizontal plate 320 and upper horizontal plate 330. Finally, the angular orientation of the bung wrench 400 with respect to the horizontal, may be adjusted by the hinge 352 connecting the vertical plate 340 to the wrench support plate 350. The angular orientation of the bung wrench 400 is important because in an over-pressurization event where a remote venting of a container 90 would be desirable, the top face 95 of the container 90 is typically deformed outwardly by the internal pressure in the container 90. Because the bung 98 is typically near the edge of the container face 95, in an over-pressurization event the bung 98 is frequently significantly rotated from its normal position. The angular position of the bung wrench 400 must be adjustable to accommodate significant deformation in the container face 95.

An extension arm 500 is connected to the third leg 415 of the T-connector 410 of the bung wrench 400, extending generally horizontally therefrom. It will be obvious to one of ordinary skill in the art that an extension arm of even moderate length will produce significant leverage, substantially reducing the force that must be applied by the user to rotate the bung 98. This leverage is especially important if deformation of the container face 95 has significantly increased the friction forces securing the bung 98 to the container 90. In the preferred embodiment, a hook 510 is provided at the end of the extension arm 500 away from the bung wrench 400. A long cable 520 which may be made from metal, plastic, fiber or similar flexible material, and optionally terminating with a handle 530 may be attached to the hook 510.

Figure 6:
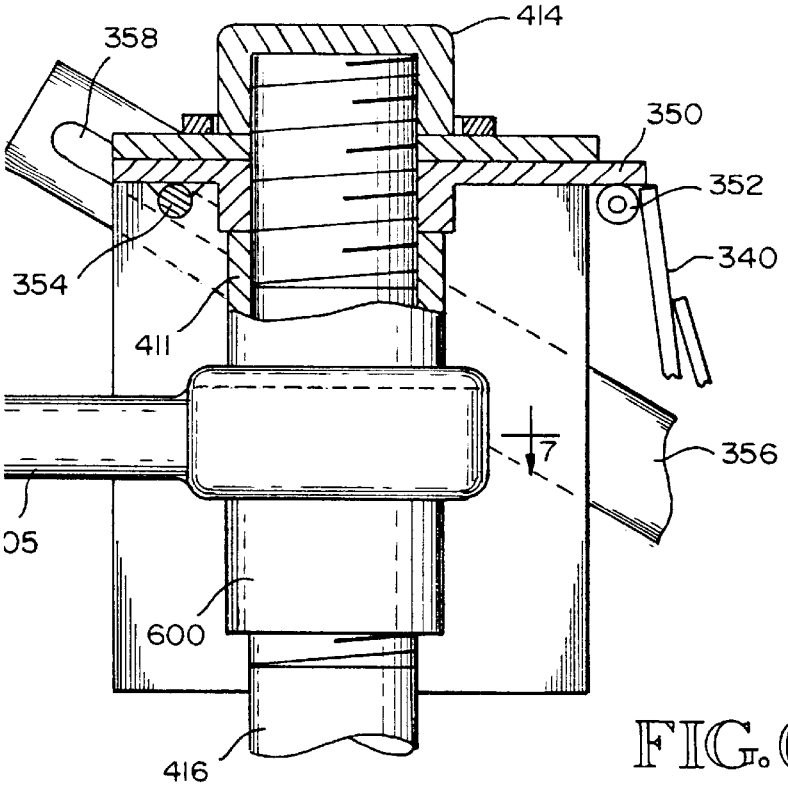
FIG. 6 is detail sectional side view of the bung wrench with a ratchet.
Figure 7:
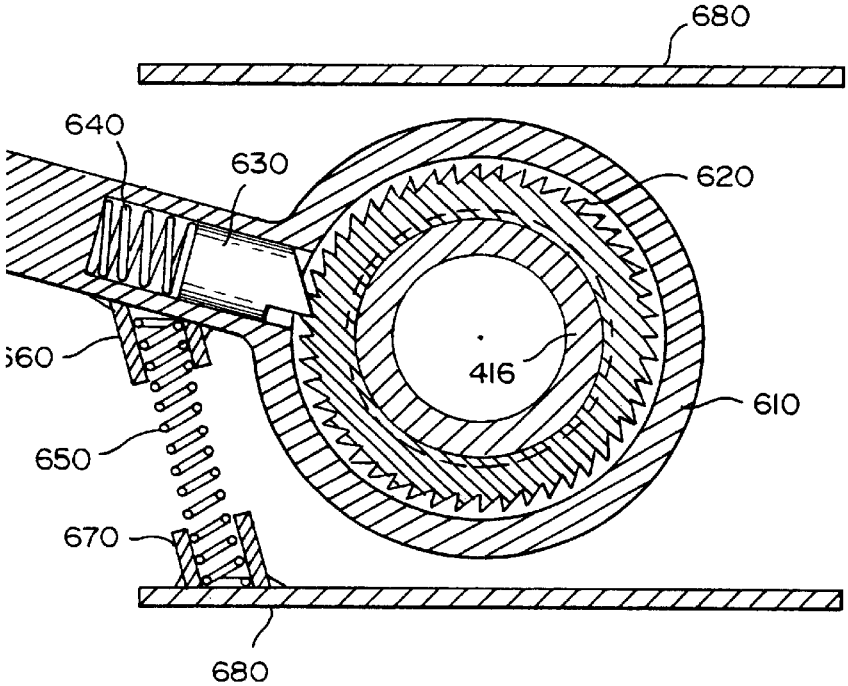
FIG. 7 is a detailed sectional top view of the bung wrench with a rachet.

An alternative embodiment of the bung wrench 400 is disclosed in FIGS. 6 and 7. The rigid T-connector 410 is replaced by a ratchet 600. The ratchet 600 is rotatably attached to the wrench support plate, extending generally downward therefrom. In this alternative embodiment, the ratchet comprises a handle 605, a housing 610, ratchet teeth 620 suitably affixed to the second tubular connector 416, a pawl 630 for engaging the ratchet teeth 620, a spring 640 to engage the pawl 630 against the ratchet teeth 620, a ratchet handle return spring 660 whose first end is suitably affixed to the ratchet handle 605 by a first mount 660 and whose second end is suitably affixed to the ratchet support plate 680 by a second mounting 670. One of ordinary skill in the art will recognize that other means may be substituted for the ratchet to allow the bung wrench to be turned more than once from a safe distance, for example a strap wrench.

To use the present invention, the strap 200 is first placed around the container 90 with the bung wrench 400 located over the bung 98. The bung engagement 420 is then carefully inserted to engage the bung 98. The strap 200 is then fixed to the container 90 by tightening wing nut 225. Wing nuts 335 and 355 are then tightened to rigidly hold the bung wrench 400 in the desired position, in engagement with the bung 98. The cable 520 is unfurled, and the operator stands with the cable 520 a safe distance from the container 90, at a location whereby pulling on the cable will cause rotation of the bung wrench 400 and hence the bung 98, thereby venting the container. After the pressure is released from the container, including a suitable period for cooling, if appropriate, the user can then safely remove the remote bung wrench 100 from the container.

The same procedure is used when the ratchet is employed. The cable 520 is attached to the ratchet handle 605 and pulled to cause rotation of the bung wrench. The ratchet allows the operator to make multiple turns of the bung without having to return to the container to reset the bung wrench.

The words "horizontal" and "vertical" are used in this application to indicate an orientation for the purposes of describing the parts of the apparatus, how the parts relate to other parts of the apparatus, and how the apparatus is orientated to the bung. As will be obvious to one of ordinary skill the in art, the apparatus can be used in any orientation to the horizon. The words "horizontal" and "vertical" are not intended to be words of limitation to the apparatus or the method.

In compliance with the statute, the invention has been described in language more or less specific as to structural features. It is to be understood, however, that the invention is not limited to the specific features shown, since the means and construction shown comprise preferred forms of putting the invention into effect. The invention is, therefore, claimed in any of its forms or modifications within the legitimate and valid scope of the appended claims, appropriately interpreted in accordance with the doctrine of equivalents.

INDUSTRIAL APPLICABILITY

The apparatus and method are used to safely vent containers, such as drums of the type commonly used to store and transport hazardous materials. It particularly pertains to a method and portable apparatus for remotely loosening the bung on a potentially over-pressurized container, thereby safely relieving excess pressure in a container and avoiding potential container rupture. The method and apparatus use only human power.

We claim:

1. An apparatus for venting a container having a bung, the apparatus comprising:

a. a strap for temporarily securing the apparatus to the container wherein the strap can be positioned at various locations on the container to align the apparatus with the bung;

b. a support structure having a bottom end connected to the strap and a top end, and having a first plate rigidly connected to the strap and a second plate slidably attachable to the first plate;

c. a bung wrench supported by the support structure, the bung wrench having a proximal end and a distal end, the proximal end rotatably connected to the support structure top end and the distal end having a bung engagement means adapted to engage the bung; and d. an extension arm having a first end attached to the bung wrench, and a second end extending laterally from the bung wrench; wherein the support structure can be variously positioned to align the bung wrench with the bung, such that when the apparatus is attached to the container with the bung wrench engaging the bung, a single operator may manually rotate the bung by pulling or pushing the extension arm such that rotation of the bung wrench will cause rotation of the bung and venting of the container.

2. The apparatus of claim 1 wherein the support structure comprises a third plate that is hingedly attached to the second plate, and the angle between the second plate and the third plate is adjustable, such that the bung wrench can be aligned with the bung.

3. The apparatus of claim 1 wherein the bung wrench further comprises a ratchet.

4. The apparatus of claim 1 wherein the bung wrench is made from a non-sparking metal.

5. The apparatus of claim 1 further comprising an elongated member attached to the the second end of the extension arm whereby the extension arm may be pulled from a distance by pulling on the elongated member.

6. The apparatus of claim 5 wherein the elongated member is a cable.

7. The apparatus of claim 1 wherein the strap is shaped such that the apparatus can be temporarily secured to a cylindrical container having a generally circular cross-section.

8. A method for remotely venting a container of the type having a bung comprising the steps of:

a. securely and rotatably attaching a bung wrench having an extension arm to the container with the bung wrench engaging the bung;

b. attaching a cable to the extension arm near the end of the extension arm furthest from the bung wrench;

c. extending the cable a distance from the container in a direction whereby pulling the cable will cause the bung wrench to rotate;

d. pulling the cable thereby rotating the bung and venting the container; and e. further pulling the cable and thereby removing the bung.

9. An apparatus for venting a container having a bung, the apparatus comprising:

a. a strap for temporarily securing the apparatus to the container wherein the strap can be positioned at various locations on the container to align the apparatus with the bring;

b. a support structure having a bottom end and a top end, wherein the bottom end is connected to the strap;

c. a bung wrench suppoited by the support structure, the bung wrench having a proximal end and a distal end, the proximal end rotatably connected to the support structure top end and the distal end having a bung engagement means adapted to engage the bring; and d. an extension ann having a first end attached to the bung wrench, and a second end extending laterally from the bung wrench; wherein when the apparatus is secured to a container having a bring, the support structure can be variously positioned to align the bung wrench with the bung, such that when the bring wrench is engaging the bung, a single operator may manually rotate the bung by pulling or pushing the extension arm such that rotation of the bung wrench will cause rotation of the bung and venting of the container.

10. The apparatus of claim 8 wherein the angle of the bung wrench relative to the bung is adjustable, such that the bung wrench can be aligned with the bung.

11. The apparatus of claim 8 wherein the bung wrench further comprises a ratchet.

12. The apparatus of claim 8 wherein the bung wrench is made from a non-sparking metal.

13.The apparatus of claim 8 further comprising an elongated member attached to the second end of the extension arm whereby the extension arm may be pulled from a distance by pulling on the elongated member.

14. The apparatus of claim 12 wherein the elongated member is a cable.

15. The apparatus of claim 8 wherein the strap is made from a flexible material.

16. The apparatus of claim 14 wherein the strap is adaptable such that it can be placed on differently sized containers.

* * * * *

UNITED STATES PATENT AND TRADEMARK OFFICE

CERTIFICATE OF CORRECTION

PATENT NO. : 6,588,300 B2
DATED : July 8, 2003
INVENTOR(S) : D.D. Ford et al.

It is certified that error appears in the above-identified patent and that said Letters Patent is hereby corrected as shown below:

Column 8,
Lines 16 and 24, “the bring;” should read -- the bung; --
Line 20, “suppoited” should read -- supported --
Line 25, “extension ann” should read -- extension arm --
Line 28, “a bring,” should read -- a bung, --
Line 30, “the bring” should read -- the bung --
Lines 36, 39, 41, 43 and 49, “claim 8” should read -- claim 9 --
Line 47, “claim 12” should read -- claim 13 --
Line 51, “claim 14” should read -- claim 15 --

Signed and Sealed this

Twentieth Day of January, 2004

JON W. DUDAS
*Acting Director of the United States Patent and Trademark Office*